US007220325B2

(12) United States Patent
Bai et al.

(10) Patent No.: US 7,220,325 B2
(45) Date of Patent: May 22, 2007

(54) HIGH-STRENGTH MICRO-ALLOY STEEL

(75) Inventors: Dengqi Bai, Bettendorf, IA (US); Michael Ambrose Cooke, Davenport, IA (US); James Asante, Regina (CA); Jonathan Dorricott, Aurora, IL (US)

(73) Assignee: IPSCO Enterprises, Inc., Lisle, IL (US)

( * ) Notice: Subject to any disclaimer, the term of this patent is extended or adjusted under 35 U.S.C. 154(b) by 0 days.

(21) Appl. No.: 10/677,873

(22) Filed: Oct. 2, 2003

(65) Prior Publication Data

US 2004/0101432 A1 May 27, 2004

Related U.S. Application Data

(62) Division of application No. 10/063,250, filed on Apr. 3, 2002, now Pat. No. 6,682,613.

(51) Int. Cl.
*C22C 38/12* (2006.01)
*C22C 38/14* (2006.01)

(52) U.S. Cl. ..... 148/328; 420/127; 420/126

(58) Field of Classification Search ..... 148/328, 148/654; 420/126, 127

See application file for complete search history.

(56) References Cited

U.S. PATENT DOCUMENTS 3,720,087 A 3/1973 Gottschlich
3,726,723 A 4/1973 Coldren et al.
3,926,687 A 12/1975 Gondo et al.
4,313,770 A 2/1982 Takahashi et al.
4,388,122 A 6/1983 Sudo et al.
4,415,376 A * 11/1983 Bramfitt et al. ..... 148/546
5,194,102 A 3/1993 Wyss
5,294,271 A 3/1994 Suzaki et al.
5,545,269 A 8/1996 Koo et al.

(Continued)

FOREIGN PATENT DOCUMENTS

JP 8-73985 * 3/1996
JP 2000-204434 * 7/2000

*Primary Examiner*—Deborah Yee
(74) *Attorney, Agent, or Firm*—Greenberg Traurig, LLP

(57) ABSTRACT

A process for enhancing precipitation strengthening in steel and for making a high-strength micro-alloy steel, and a steel made from the process. The process includes the step of deforming the steel containing a suitable precipitate strengthening substance, at a temperature at which the microstructure of the steel is essentially stable and at which those precipitation strengthening particles that form are of a desirable particle size for precipitation strengthening. Deforming the steel introduces dislocations in the crystal structure of the steel, which increases the kinetics of precipitation by increasing the number of precipitation nucleation sites and accelerating the rate of diffusion of the precipitate material. The steel may be deformed by bending or rolling the steel. Preferably the process also includes the step of cooling the steel at a rapid rate so as to minimize the formation of precipitate particles of a larger-than-desired size.

16 Claims, 8 Drawing Sheets

U.S. PATENT DOCUMENTS

| | | | |
|---|---|---|---|
| 5,554,233 | A | 9/1996 | Heitmann et al. |
| 5,762,724 | A | 6/1998 | Yamaoka et al. |
| 5,810,951 | A | 9/1998 | Dorricott |
| 5,858,130 | A | 1/1999 | Bodnar et al. |
| 5,876,521 | A | 3/1999 | Koo et al. |
| 5,895,534 | A | 4/1999 | Daley et al. |
| 5,900,075 | A | 5/1999 | Koo et al. |
| 6,059,905 | A | 5/2000 | Friedman et al. |
| 6,096,146 | A | 8/2000 | Poloni et al. |
| 6,106,638 | A | 8/2000 | Paradis et al. |
| 6,221,179 | B1 | 4/2001 | Yasuhara et al. |
| 6,264,760 | B1 | 7/2001 | Tamehiro et al. |
| 6,264,767 | B1 | 7/2001 | Frank et al. |
| 6,270,594 | B1 | 8/2001 | Bodnar et al. |
| 6,290,784 | B1 | 9/2001 | Yasuhara et al. |
| 6,290,789 | B1 | 9/2001 | Toyooka et al. |
| 6,331,216 | B1 | 12/2001 | Toyooka et al. |
| 6,334,912 | B1 | 1/2002 | Ganin et al. |
| 6,666,932 | B2 * | 12/2003 | Funakawa et al. ..... 148/328 |
| 2001/0014404 | A1 | 8/2001 | Miyake et al. |
| 2001/0020502 | A1 | 9/2001 | Miyake et al. |
| 2001/0023719 | A1 | 9/2001 | Troeger et al. |
| 2001/0041149 | A1 | 11/2001 | Mino |

* cited by examiner

HIGH-STRENGTH MICRO-ALLOY STEEL

This is a divisional application of U.S. patent application Ser. No. 10/063,250, filed Apr. 3, 2002, now U.S. Pat. No. 6,682,613.

FIELD OF THE INVENTION

This invention relates to a process for making steel having enhanced precipitation strengthening and to high-strength micro-alloy steel made by means of the process.

BACKGROUND OF THE INVENTION

Many of the industrially-significant attributes of different steels (strength, hardness etc.) depend in part on the microstructure of the particular steel, that is the type or types of crystals of which the steel is composed and the grain size of the crystals. In typical steel manufacturing, the steel undergoes processing in order to produce a desired microstructure. Such processing typically includes thermal processing (including controlling the cooling rate of the steel to promote the formation of particular crystal structures in the steel) and mechanical processing (including reducing the thickness of the steel by rolling the steel, so as to, for example, cause recrystallization for the purpose of reducing the grain size of the steel). The attributes of a steel can also be affected by the addition of precipitation strengthening substances, that is, alloying substances that dissolve when the steel is heated and then tend to precipitate in the boundaries between the grains of the steel when the steel cools. The precipitate particles thus created build up resistance to slip between steel grains, thereby increasing the strength of the steel, particularly the yield strength.

The known precipitation strengthening substances suitable for use in steel include, niobium (referred to at times herein as Nb), titanium (referred to at times herein as Ti) and vanadium (referred to at times herein as V). Niobium typically combines with carbon (referred to at times herein as C) and possibly nitrogen (referred to at times herein as N), and precipitates as Nb(C,N) and/or NbC. Titanium typically combines with carbon and precipitates as TiC. Vanadium typically combines with nitrogen or carbon and precipitates as VN or VC. Niobium, titanium and vanadium may be present in steel for purposes other than direct precipitation strengthening and will, during typical steel production, combine with other alloying substances in the steel, but the above compounds (Nb(C,N), NbC, TiC, VN and VC) are those that are considered to be associated with, and significant for, ultimate precipitation strengthening. Titanium will also form TiN with nitrogen, but this is not a useful precipitation strengthening compound, largely because TiN forms and precipitates at relatively high temperatures, resulting in larger-than-desired precipitate particles (discussed generally in what follows). Various other possible precipitation strengthening compounds are also known, including: Ti(C,N), V(C,N) and TiNb(C,N).

The extent to which the addition of such precipitating substances increases the strength of the steel depends in part on the ultimate size and volume fraction of the precipitate particles. It is well known that the strengthening effect of such precipitation increases as the volume fraction of the precipitate particles increases and the precipitate particle size decreases. For a given volume fraction of precipitates, a smaller particle size means a higher number density of precipitate particles, that is, a higher number of interactions between precipitate particles and steel grains, and thus higher strength. With Nb(C,N) and/or NbC precipitation strengthening in ferrite steel, for a given volume fraction, the increase in yield strength attributable to precipitation strengthening increases by about one order of magnitude when the precipitate particle size is reduced from about 100 nm to about 3 nm.

For a given precipitating substance, precipitate particle size is primarily dependent on the temperature at which the particles form. Generally, the lower the temperature at which the precipitate particles form, the smaller the particle size. The volume fraction of the precipitate particles depends in part on the rate at which the precipitating substance diffuses within the solid metal. Generally the rate of diffusion is a function of temperature; a higher temperature resulting in a higher diffusion rate and thus a higher volume fraction of precipitate particles.

For some metals and some precipitating substances, the diffusion rate of the precipitating substance is sufficiently high at relatively low temperatures, (for example, room temperature) that significant precipitation strengthening occurs at these relatively low temperatures. Precipitation strengthening that occurs over time at room temperature, referred to as aging, generally produces relatively fine precipitate particles. For steel, the diffusion rate of the known precipitating substances is too low at room temperature to produce an appreciable volume fraction of precipitate particles, which means that aging does not result in significant precipitation strengthening. For example, although Nb(C,N) and/or NbC precipitation is thermodynamically possible in ferrite steel at relatively low temperatures, such as below about 500° C., because of the sluggish precipitation kinetics at these temperatures, only a minimal Nb(C,N) and/or NbC precipitation strengthening effect has been observed at these temperatures under industrial conditions.

It is known to reheat metals containing precipitating substances off-line to increase the rate of diffusion of the precipitating substances and thus increase the volume fraction of the precipitate. However, off-line heat treatment is generally not an effective way to enhance precipitation strengthening in steel. For steel and the precipitating substances known to be appropriate for steel, re-heating the steel to a temperature sufficiently high to increase the diffusion rate of the precipitating substance so as to increase the volume fraction of the precipitate particles within a commercially-reasonable period of heating time, generally results in a larger-than-desirable precipitate particle size. As well, off-line heat treatment of steel is costly and typically, and significantly, results in a loss of desirable microstructure characteristics of the steel. Therefore, off-line heat treatment is typically not the best technique for enhancing precipitation strengthening in steel.

What is needed is a process that increases the volume fraction of fine precipitates in steel so as to result in enhanced precipitation strengthening.

BRIEF SUMMARY OF INVENTION

In accordance with an aspect of the present invention, there is provided a process for producing steel having a desired microstructure, and precipitation strengthening particles of a desired particle size and volume fraction for enhanced precipitation strengthening, the process including the steps of:

a) heating steel containing a precipitation strengthening substance to a selected dissolving temperature selected to dissolve substantially all of the precipitation strengthening substance in the steel;

b) processing the steel to produce the desired microstructure;

c) cooling the steel to a selected target temperature at which the desired microstructure is essentially stable and at which those precipitation strengthening particles that form tend to be of the desired particle size; and d) with the steel at the selected target temperature, deforming the steel to introduce dislocations into crystal structure of the steel so as to increase the kinetics of precipitation, and thus the volume fraction, of precipitation strengthening particles of the desired particle size.

Note that if the steel is being made as part of an on-line processing operation involving rolling after, say, continuous casting optionally followed by reheating, steps (a) and (b) can be conventional in character, and no special subsequent heating and processing steps are required before steps (c) and (d) are taken; the as-rolled steel can be cooled to a selected temperature pursuant to step (c) and then deformed pursuant to step (d).

Introducing dislocations in the crystal structure of steel is understood to increase the kinetics of precipitation by both: increasing the number of nucleation sites; and to increase the kinetics of diffusion in that vacancies in the crystal structure associated with the dislocation of the crystal structure accelerate the diffusion of the precipitating substances.

The precipitating substance may be any suitable precipitation strengthening substance, including niobium, titanium or vanadium, or combinations of suitable substances. A skilled metallurgist will be able to determine appropriate precipitating substances having due regard to the desired characteristics of the end product.

Advantageously, for many precipitation strengthening substances, the selected target temperature (that is the temperature at which the precipitate particles that form tend to be of a selected target size desirable for precipitation strengthening) is a temperature at which the microstructure of steel is essentially stable. Thus, enhanced precipitation strengthening can be achieved through deforming the steel at the target temperature without loss of desirable microstructure features of the steel.

The steel may be deformed by bending or rolling the steel or by any other means appropriate for steel when at the selected target temperature.

Preferably, the time period between the time when the steel is heated to dissolve the precipitation strengthening substance, and the time when the steel is at the target temperature and the dislocations are introduced, is kept as short as possible (subject to the time required for any thermomechanical processing required to produce a desired microstructure) so as to minimize the formation of precipitate particles of larger than the desired target size. As is well known, the precipitate particles that form at higher temperatures tend to be larger than those that form at lower temperatures. Such larger-than-desired precipitate particles are not as effective at precipitation strengthening as precipitate particles of the smaller, desired target size, and the formation of such larger-than-desired precipitate particles consumes precipitation strengthening substance that would otherwise be available for precipitation at the desired target temperature.

In accordance with another aspect of the present invention, there is provided a more detailed process conforming generally with the previously defined process, for making a steel having enhanced precipitation strengthening. The process is preferentially applicable to the production of high-strength micro-alloyed structural steels, and pressure-vessel or line-pipe-grade steels. In a preferred embodiment of the process, the steel to which the process is applied is low-carbon for good weldability. The steel may also contain other alloying elements such as manganese and molybdenum for purposes other than precipitation strengthening. The steel-making process includes the steps of:

a) heating steel containing a precipitation strengthening substance to a selected dissolving temperature selected to dissolve substantially all of the precipitation strengthening substance in the steel;

b) with the steel at a temperature above the temperature below which austenite does not recrystallize ($T_{nr}$), breaking down the austenite grains through multiple recrystallization cycling to produce an austenite grain size of about 30 μm or less;

c) with the steel at a temperature below the $T_{nr}$ but above the temperature at which austenite begins to change to ferrite on cooling ($A_{r3}$), producing a heavily pancaked austenite structure in the steel;

d) cooling the steel at a rate of about 15° C./sec to about 20° C./sec from a temperature above the $A_{r3}$ to a stop-cooling temperature between about 350° C. and about 450° C.; and e) with the steel at a temperature between about 350° C. and about 450° C., deforming the steel to introduce dislocations in the crystal structure of the steel so as to enhance precipitation of the precipitating substance.

The heating of the steel in step a) above, is to a temperature sufficiently high to dissolve substantially all of the precipitating substances. Preferably, the steel is heated about 50° C. higher than the estimated equilibrium solution temperature of the precipitating substances to ensure that substantially all of the precipitating substances are dissolved. However, the steel may be heated to a temperature closer to the equilibrium solution temperature although it may take longer to dissolve substantially all of the precipitating substances at temperatures below 50° C. above the equilibrium solution temperature. At temperatures above 50° C. above the equilibrium solution temperature, dissolving substantially all of the precipitating substances would take less time. Too high a temperature will result in the grain size being undesirably coarsened. Depending on the steel chemistry, a temperature of at least about 1050° C. and no more than about 1350° C. may be appropriate. The steel that is heated may be in the form of a previously-cast slab, such that the heating of the steel involves reheating the slab, in conformity with conventional steel mill practice. However, it may be that the slab is received from the caster at the desired sufficiently high temperature, such that the heating of the steel in step a) results, in the as-cast steel, from the casting of the steel, and in such case it is not necessary as a separate discrete heating step to reheat the slab to the desired temperature.

An appropriate temperature at which to break down the austenite grains through multiple recrystallization cycling, as referred to in step b) above, may at least be slightly higher than the $T_{nr}$ and no more than about 1200° C. The breaking down of the austenite grains may be through multiple recrystallization cycling by rolling the steel for a series of reducing roughing passes, such as in a Steckel mill having associated coiler furnaces. Preferably the temperature of the steel for the first roughing pass is about 1200° C. and the temperature of the steel for the last roughing pass is slightly higher than the $T_{nr}$. The use of a Steckel mill with associated coiler furnaces to facilitate multiple recrystallization cycling has been previously described, for example in Dorricott U.S. Pat. No. 5,810,951, granted on 22 Sep. 1998. The roughing passes cause recrystallization of the steel by deforming the steel so as to introduce dislocations that are stored in the structure of the steel, making the microstructure unstable and creating grain nucleation sites in the boundaries between the grains. As is well known to persons skilled in the art of metallurgy, since the steel is above the $T_{nr}$, by definition the temperature above which austenite will recrystallize, new strain-free grains will tend to form in the grain nucleation sites. If the number density of the stored dislocations is high enough, the new grains will grow and gradually replace the deformed grains. The newly formed grains will tend to have a higher number density and smaller grain size than grains formed earlier in the process. When a new deformation-recrystallization cycle starts, these grains will provide more nucleation sites for the "next generation" grains. Each roughing pass will introduce new grain nucleation sites and thus promotes the formation of additional grains. In this way, multiple roughing passes, and a multiple cycle of deformations, increases the number of nucleation sites and thus grains, and reduces the average size of the grains.

The steel temperature below the $T_{nr}$ but above the $A_{r3}$ (referred to above in step (c)) may be achieved by merely exposing the steel to air of ambient temperature, such as by removing the steel from the Steckel mill and associated coiler furnaces, if such are used in the rolling of the steel. Depending on the steel chemistry, the $A_{r3}$ temperature may be roughly 780° C. The heavily pancaked austenite structure, as referred to in step c) above, may be produced by rolling the steel (such as in a Steckel mill with associated coiler furnaces) in the temperature range of between the $T_{nr}$ and the $A_{r3}$ for sufficient finishing passes to reduce the steel thickness by preferably about 70%. The steel temperature for the finishing passes should be at least about 20° C. higher than the $A_{r3}$ and no higher than about 50° C. less than the $T_{nr}$. Preferably, the steel temperature for the first finishing pass is about 50° C. less than the $T_{nr}$ and the steel temperature for the last finishing pass is about 20° C. higher than the $A_{r3}$.

Any precipitation of the precipitating substances that occurs while the steel is in the austenitic region (that is, at temperatures above the $A_{r3}$) contributes little to the ultimate strength of the steel, in that the resulting precipitate particle size is larger than desired for optimum precipitation strengthening. It is preferable to minimize the coarser precipitates formed at higher temperatures so as to preserve the precipitation material for low temperature precipitation. Thus it is preferable to keep the steel at temperatures above the $A_{r3}$ for as short a time as possible. The speed at which the roughing passes step can occur is typically not limited by current mill technology, but is limited by the necessity of providing sufficient time between roughing passes for a desired amount of recrystallization to occur. The time between roughing passes depends in part on the steel chemistry, the grain size and the reduction for each roughing pass. A person skilled in the art of metallurgy will be able to determine an appropriate time between roughing passes. It is desirable to complete the finishing passes as rapidly as mill conditions permit.

Preferably the deforming of the steel (referred to above in step (e)) is by introducing bending strains into the steel or by a rolling reduction of the thickness of the steel. A relatively small deformation, for example a sustained strain of about 0.1 has been observed to accelerate the precipitation process by about two orders of magnitude. The increase in precipitation kinetics resulting from a relatively-low-temperature plastic deformation of the steel produces an appreciable volume fraction of extremely fine precipitate particles and consequently, significant precipitation strengthening. In the temperature range referred to in step (e) above (i.e. at least about 350° C. and no more than about 450° C.), the rate of precipitation of the known precipitating substances would normally be relatively low. However, it is understood that introducing dislocations in the crystal structure of the steel facilitates precipitation strengthening by both increasing the number of nucleation sites and accelerating the diffusion rate of the precipitating substances. In this temperature range the microstructure features of the steel are essentially stable, such that enhancing precipitation strengthening by deforming the steel while it is in this temperature range will not unacceptably detrimentally affect the microstructure of the steel.

If the steel is in plate form, the roughing passes, finishing passes and accelerated cooling will tend to introduce imperfections into the steel in the form of bends or ripples. Preferably such plate is deformed by the introduction of bending strains in the plate such as by being passed through a hot leveller to level (or straighten) the plate. The number of dislocations thus introduced in the steel depends on the total bending strain introduced by the hot leveller. It has been observed by the inventors that, if a plate being levelled is subjected to a total strain of about 4 to about 5 yield strains, the number density of dislocations is sufficient to produce significant precipitation strengthening. The inventors expect that a total strain in the range of about 1 to about 7 yield strains would be suitable for enhancing precipitation strengthening. For bending deformation such as introduced by a hot leveller, the maximum suitable deformation is clearly less than the deformation that would cause cracks to form in the steel.

Alternatively or additionally to being levelled, the steel may be deformed by being passed through a final-pass roller for a final rolling reduction pass. The inventors expect that if the steel is not also levelled, a final rolling reduction in the range of about 1% to about 5% would be effective to enhance precipitation strengthening. As well as enhancing precipitation strengthening, a final rolling reduction of at least about 1% and no more than about 5% would improve control of the final gauge of the steel and improve the surface quality of the steel.

It will be apparent to skilled metallurgists that various other methods for deforming the steel so as to introduce dislocations in the crystal structure of the steel could be used to obtain enhanced precipitation strengthening.

For steel having the following chemistry:

at least about 0.01 and no more than about 0.1% wt. carbon;

at least about 0.03 and no more than about 0.12% wt. niobium;

at least about 0.008 and no more than about 0.03% wt titanium;

at least about 1 and no more than about 1.9% wt. manganese;

at least about 0.1 and no more than about 0.5% wt. molybdenum;

a maximum phosphorus content of about 0.02% wt.;

a maximum sulfur content of about 0.015% wt.;

a maximum nitrogen content of about 0.015% wt.; and the balance being iron (Fe) and incidental impurities;

the above-described steel-making process produces steel with a microstructure of about 30% polygonal ferrite and about 70% acicular ferrite with an average grain size of about 5 μm or less; and having precipitate particles of NbC and Nb(C,N) with a precipitate particle size of generally less than about 5 nm and probably in the range of about 1 to about 3 nm.

Carbon is kept low in this steel for good weldability. As well, with respect to precipitation strengthening by the formation of NbC, only a very small amount of carbon is required for the purpose of combining with niobium because of the stoichiometric ratio (Nb/C=7.74). Thus, the inventors predict that the amount of carbon required to be present in the steel may be less than the rough minimum set out above.

Titanium is present in this steel to increase castability and to prevent grain growth during high-temperature reheating. Titanium is known to be an effective micro-alloying element for retarding grain coarsening. Titanium combines with nitrogen to form TiN which is stable at temperatures as high as about 1300° C. and can effectively retard the migration of grain boundaries. Thus TiN is effective for grain growth prevention over a large temperature range. Other alloying elements could be present in the steel to prevent grain growth but the known alternatives are not viewed as being as effective as titanium and/or are more expensive than titanium. For example, niobium can be used to form Nb(C, N) precipitation to prevent grain growth during high temperature reheating. However, at a temperature higher than about 1200° C., unless an unusually large, and therefore probably prohibitively-expensive, amount of niobium were present in the steel, most of the Nb (C,N) would dissolve into the steel matrix and would be ineffective in terms of retarding grain growth.

If too little titanium is present in this steel, the titanium may not be effective to prevent grain growth. If too much titanium is present, it may result in reduced toughness of this steel, particularly if the amount of nitrogen in the steel is relatively high. Preferably at least about 0.008 and no more than about 0.03% wt of titanium is present in this steel. More preferably, at least about 0.015 and no more than about 0.02% wt of titanium is present in this steel. Even more preferably, about 0.018% wt of titanium is present in this steel.

Manganese and molybdenum are present in this steel primarily to facilitate the formation of the desired microstructure. In particular, molybdenum acts with niobium to synergistically suppress the formation of polygonal ferrite and promote the formation of acicular ferrite. As well, manganese and molybdenum tend to impede the precipitation of Nb(C,N) in austenite and thus increase the amount of niobium available to precipitate at lower temperatures in ferrite, by both increasing the solubility of Nb(C,N) in austenite, and decreasing the rate of diffusion of niobium in austenite. Preferably at least about 1.4 and no more than about 1.9% wt of manganese is present in this steel. Preferably, at least about 0.1 and no more than about 0.5% wt of molybdenum is present in this steel.

The concentrations of phosphorus, sulfur and nitrogen are compatible with melting the steel in electric arc furnaces. The maximum phosphorus content of the steel is about 0.02% wt. More preferably, the maximum phosphorus content of the steel is about 0.018% wt. The maximum sulfur content of the steel is about 0.015% wt. More preferably, the maximum sulfur content of the steel is about 0.01% wt. The maximum nitrogen content of the steel is about 0.015% wt. More preferably, the maximum nitrogen content of the steel is about 0.013% wt.

The incidental impurities present in the steel may include miscellaneous non-essential elements, having, when present in sufficient quantity, an alloying effect on steels containing them, but whose effect on the steels described herein is innocuous.

As set out above, it is well known that various alternative precipitate-forming substances undergo precipitation in a manner similar to NbC and Nb(C,N) and thus, as with NbC and Nb(C,N), the kinetics of precipitation of these alternative precipitate-forming substances is expected to be increased by the introduction of dislocations into steel containing these alternative precipitate-forming materials. It will accordingly be clear to skilled metallurgists that precipitate-forming substances other than niobium may be present in this steel, including but not limited to: vanadium (to combine with nitrogen or carbon to form VN or VC); and titanium (to combine with carbon to form TiC).

The tendency of titanium to combine with nitrogen at relatively high temperatures means that titanium is not effective for enhanced precipitation strengthening unless the amount of nitrogen in the steel is relatively low, that is, the steel has a maximum nitrogen content of about 0.005% wt. Otherwise, much of the titanium will be consumed at higher temperatures, that is, it will combine with nitrogen and as a result not be available to perform a precipitation-strengthening function in the steel. A suitable chemistry for a steel having titanium as the significant precipitating substance for precipitation strengthening (and therefore being relatively low in nitrogen) is as follows:

- at least about 0.01 and no more than about 0.1% wt. carbon;
- at least about 0.03 and no more than about 0.15% wt. titanium;
- at least about 1.0 and no more than about 1.9% wt. manganese;
- at least about 0.1 and no more than about 0.5% wt. molybdenum;
- a maximum phosphorus content of about 0.02% wt.;
- a maximum sulfur content of about 0.015% wt.;
- a maximum nitrogen content of about 0.005% wt.; and
- the balance being iron (Fe) and incidental impurities.

A suitable chemistry for a steel having niobium and/or titanium as the significant precipitating substance for precipitation strengthening (and therefore also being relatively low in nitrogen) is as follows:

- at least about 0.01 and no more than about 0.1% wt. carbon;
- at least about 0.03 and no more than about 0.15% wt. titanium and a maximum niobium content of 0.12% wt., such that the total combined amount of titanium and niobium is at least about 0.03 and no more than about 0.2% wt.;
- at least about 1.0 and no more than about 1.9% wt. manganese;
- at least about 0.1 and no more than about 0.5% wt. molybdenum;
- a maximum phosphorus content of about 0.02% wt.;
- a maximum sulfur content of about 0.015% wt.;
- a maximum nitrogen content of about 0.005% wt.; and
- the balance being iron (Fe) and incidental impurities.

Vanadium may be present in the steel as a precipitating substance either in addition to niobium, or as an alternative to niobium. If niobium and vanadium are both present in the steel for precipitation strengthening, the total amount of these two substances should not exceed about 0.2% wt. Since one of the desired precipitating compounds of vanadium contains nitrogen (VN) and titanium tends to combine with nitrogen at relatively high temperatures (thus potentially using up much of the titanium and the nitrogen), if vanadium is being present in steel for precipitation strengthening, the amount of titanium in the steel should be no greater than about 0.03% wt. A suitable chemistry for a steel having niobium and/or vanadium as the significant precipitating substance for precipitation strengthening is as follows:

- at least about 0.01 and no more than about 0.1% wt. carbon;
- a maximum niobium content of about 0.12% wt. and a maximum vanadium content of about 0.12% wt., such that the total combined amount of niobium and vanadium is at least about 0.03% wt. and no more than about 0.2% wt.;
- at least about 0.008 and no more than about 0.03% wt. titanium;
- at least about 1.0 and no more than about 1.9% wt. manganese;
- at least about 0.1 and no more than about 0.5% wt. molybdenum;
- a maximum phosphorus content of about 0.02% wt.;
- a maximum sulfur content of about 0.015% wt.;
- a maximum nitrogen content of about 0.015% wt.; and
- the balance being iron (Fe) and incidental impurities.

The various features of novelty that characterize the invention are pointed out with more particularity in the claims. For a better understanding of the invention, its operating advantages and specific objects attained by its use, reference should be made to the accompanying drawings and descriptive matter in which there are illustrated and described preferred embodiments of the invention.

DETAILED DESCRIPTION

Figure 1:
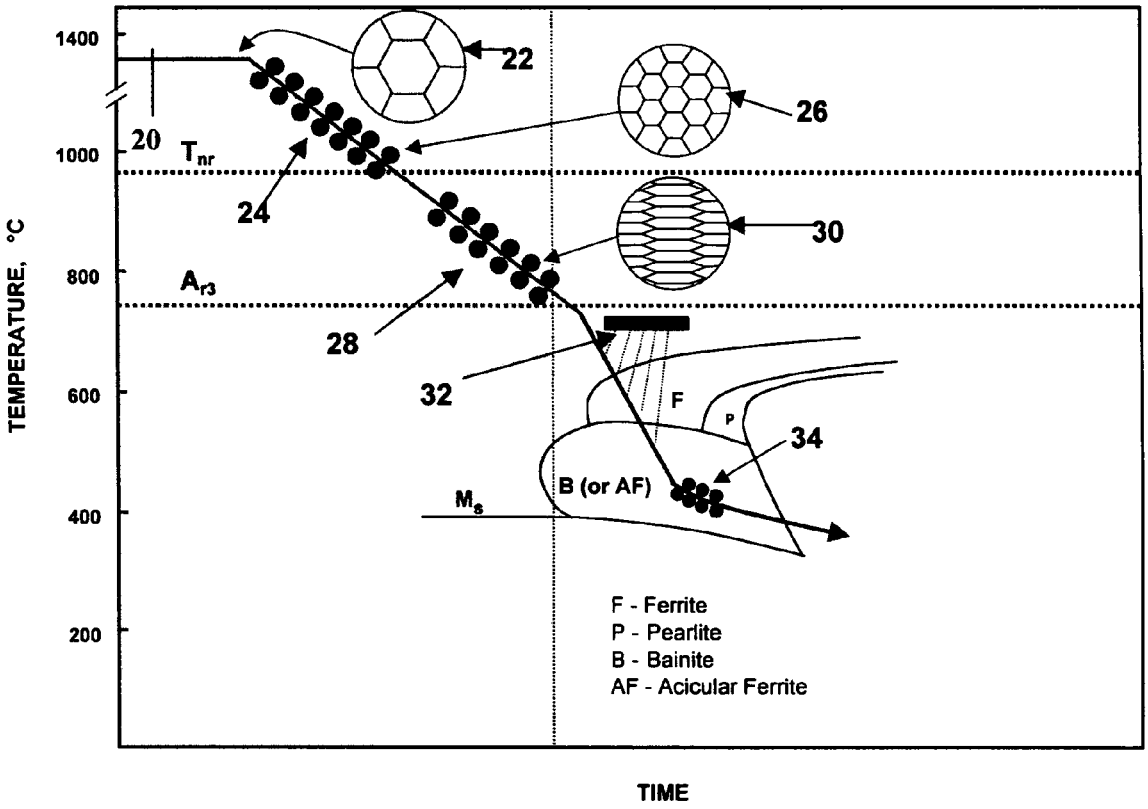
FIG. 1 is a schematic diagram showing an embodiment of the present process for making steel, in quasi-graph form with steel temperature on the vertical axis and time on the horizontal axis.

FIG. 1 is a schematic representation of an exemplary embodiment of the process of the present invention for producing a high-strength, micro-alloy steel having enhanced precipitation strengthening. The temporal and temperature path of the steel during this process is indicated as path 20 in FIG. 1.

The exemplary process is used for producing a line-pipe-grade steel that is particularly suited for pipeline and pressure vessel applications. This line-pipe-grade steel has the following chemistry:

- at least about 0.01 and no more than about 0.1% wt. carbon;
- at least about 0.03 and no more than about 0.12% wt. niobium;
- at least about 0.008 and no more than about 0.03% wt. titanium;
- at least about 1.0 and no more than about 1.9% wt. manganese;
- at least about 0.1 and no more than about 0.5% wt. molybdenum;
- a maximum phosphorus content of about 0.02% wt.;
- a maximum sulfur content of about 0.015% wt.;
- a maximum nitrogen content of about 0.015% wt.; and
- the balance being iron (Fe) and incidental impurities.

Preferably this line-pipe-grade steel is made by being melted in an electric arc furnace. The concentrations of phosphorus, sulfur and nitrogen are compatible with melting the steel in electric arc furnaces. The maximum phosphorus content of the steel is about 0.02% wt. More preferably, the maximum phosphorus content of the steel is about 0.018% wt. The maximum sulfur content of the steel is about 0.015% wt. More preferably, the maximum sulfur content of the steel is about 0.01% wt. The maximum nitrogen content of the steel is about 0.015% wt. More preferably, the maximum nitrogen content of the steel is about 0.013% wt.

The steel is heated (preferably by a twin shell electric arc furnace (not shown)) and formed into a slab (preferably by continuous casting). The slab is surface inspected and any surface defects, such as corner cracks and transverse cracks are removed by scarfing, that is, an oxygen torch is used to remove a thin surface layer containing the defects.

The slab is reheated to about 1200° C., being a temperature sufficiently high to dissolve substantially all of the precipitating substances in the steel matrix. At this temperature, the microstructure of the steel essentially consists of relatively-large austenite grains, shown schematically in FIG. 1 as indicated by reference number 22. After being heated to this temperature the slab is passed into a rolling mill, such as a four-high Steckel mill having associated coiler furnaces (not shown).

With the slab at a temperature above the temperature below which austenite does not recrystallize ($T_{nr}$), the slab is rolled for several roughing passes, shown schematically in FIG. 1 as indicated by reference number 24. The roughing passes (24) break down the austenite grains through multiple recrystallization cycling such that, by the end of the roughing passes (24), the recrystallized austenite (shown schematically in FIG. 1 as indicated by reference number 26) is expected to have a grain size of about 30 μm or less. An appropriate temperature at which to break down the austenite grains through multiple recrystallization cycling, as referred to in step b) above, may be at least be slightly higher than the $T_{nr}$ and no more than about 1200° C. Preferably the temperature of the steel for the first roughing pass is about 1200° C. and the temperature of the steel for the last roughing pass is slightly higher than the $T_{nr}$.

After the roughing passes (24), the steel is cooled to a temperature below the $T_{nr}$ but above the temperature at which austenite begins to change to ferrite on cooling ($A_{r3}$). Depending on the steel chemistry, this temperature may be roughly 780° C. The steel may be cooled merely by exposing the steel to air of ambient temperature, such as by removing the steel from the Steckel mill and associated coiler furnaces, referred to as holding out (meaning holding the steel outside the Steckel mill and outside the coiler furnaces), in which case, the required duration of the cooling period depends in part on the starting thickness of the slab and the total reduction achieved in the roughing passes. For example, with a starting slab thickness of about 6" and a total reduction in the roughing passes of about 80%, it has been found that a holding-out period of about 80 seconds is suitable.

Once the steel is at a temperature between the $T_{nr}$ and the $A_{r3}$, it is rolled in the Steckel mill for several finishing passes (shown schematically in FIG. 1 as indicated by reference number 28) so as to produce a heavily pancaked austenite microstructure (shown schematically in FIG. 1 as indicated by reference number 30).

The total reduction of the finishing passes should be about 55% or greater, preferably about 60% or greater, and more preferably about 70% or greater, to create the desired heavily pancaked structure. The reduction for each finishing pass is preferably in the range of at least about 10 and no more than about 30%. Preferably, the maximum total reduction of the roughing passes is such that about a 70% or greater total reduction is possible for the finishing passes. That is, the total reduction of the roughing passes depends on the starting thickness of the slab and the desired final thickness of the plate. For example, with a starting slab thickness of 6" (152.4 mm) and a desired final steel thickness of 0.358" (9.1 mm), a total roughing passes reduction of about 80% will permit a total finishing passes reduction of about 70%. The reduction per each roughing pass is preferably not less than about 10%. More preferably the reduction for the first roughing pass is not less than about 15%, and the reduction for the last roughing pass is not less than about 20% and still more preferably not less than about 25%. The speed at which the roughing passes step can occur is typically not limited by current mill technology, but is limited by the necessity of providing sufficient time between roughing passes for a desired amount of recrystallization to occur. The time between roughing passes depends in part on the steel chemistry, the grain size and the reduction for each roughing pass. It is desirable to complete the finishing passes as rapidly as mill conditions permit. A person skilled in the art of metallurgy will be able to determine suitable total reductions for the roughing and finishing passes, suitable reduction per each roughing and finishing pass, and suitable time between each roughing pass.

The steel should be kept at a temperature above the $A_{r3}$ and below the $T_{nr}$ during the finishing passes (28). Preferably, the steel temperature for the finishing passes should be at least about 20° C. higher than the $A_{r3}$ and no higher than about 50° C. less than the $T_{nr}$. Preferably, the steel temperature for the first finishing pass is about 50° C. less than the $T_{nr}$ and the steel temperature for the last finishing pass is about 20° C. higher than the $A_{r3}$.

After the finishing passes (28) are complete, and preferably immediately after the finishing passes (28) and starting with the steel at a temperature close to, but above the $A_{r3}$, the steel is cooled with an accelerated cooling unit (shown schematically in FIG. 1 as indicated by reference number 32) at a rate of at least about 15° C./sec and no more than about 20° C./sec to a temperature of at least about 350° C. and no more than about 450° C. (preferably about 400° C.). Preferably, the accelerated cooling unit (32) is a laminar run-out table, for example as disclosed in the previously-mentioned Dorricott U.S. Pat. No. 5,810,951.

The foregoing start-accelerated-cooling temperature, cooling rate and stop-cooling temperature selection results in a typical microstructure of about 30% polygonal ferrite and about 70% acicular ferrite. Due partly to the above-described recrystallization and pancaking of the austenite microstructure, and depending on the steel chemistry, the typical average grain size is generally no more than about 5 μm.

After the accelerated cooling, that is, with the steel plate at a temperature at least about 350° C. and no more than about 450° C. (preferably about 400° C.), the steel is deformed to introduce dislocations in the crystal structure of the steel.

Figure 2:
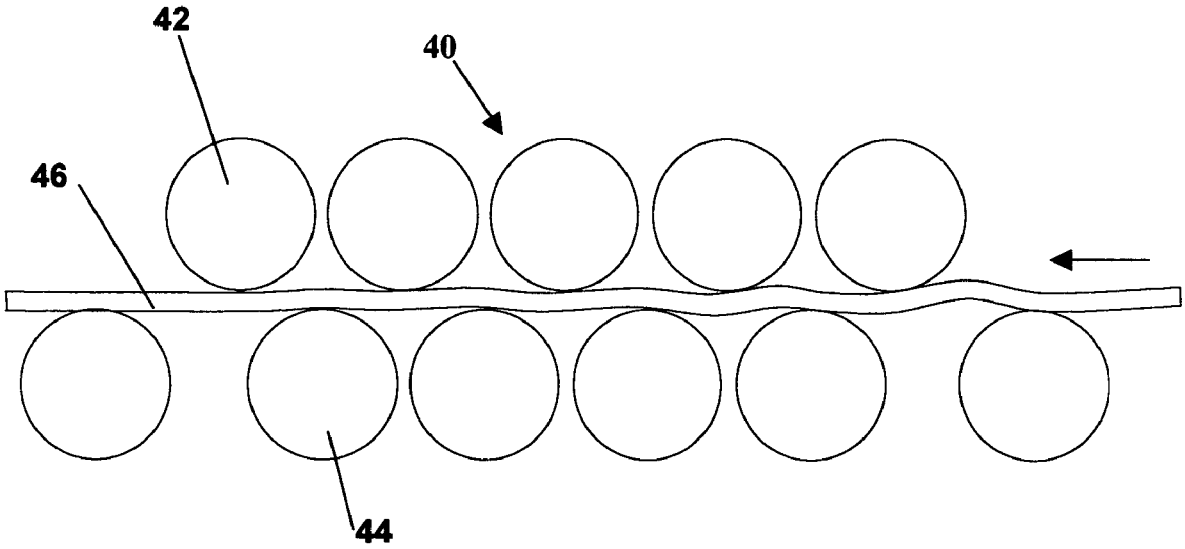
FIG. 2 is a schematic diagram showing the function of a hot leveller suitable for use in an embodiment of the present process for making steel.

In the embodiment shown in FIG. 1, the steel is deformed by being levelled (shown schematically in FIG. 1 as indicated by reference number (34). The roughing passes (24), finishing passes (28) and accelerated cooling produce steel plate (46) that tends to have imperfections in the form of bends or ripples. Levelling the steel involves removing these imperfections. Levelling of the steel may be done by passing the steel through a hot leveller (40) to straighten the steel, as shown schematically in FIG. 2. The hot leveller (40) includes a row of upper rollers (42) and a row of lower rollers (44). The upper rollers (42) are offset with respect to the lower rollers (44). As the steel plate (46) passes through the hot leveller (40), the steel plate (46) is deformed in that the bends in the steel plate (46) are flattened, but the thickness of the steel plate (46) is not reduced. An example of an appropriate hot leveller is the 120-inch Steckel Mill Hot Plate Leveller manufactured by Mannesmann Demag Sack. The bending deformation applied to the steel by the hot leveller (40) in the exemplary process for producing this line-pipe-grade steel was in the range of 4 to 5 yield strains.

Figure 10:
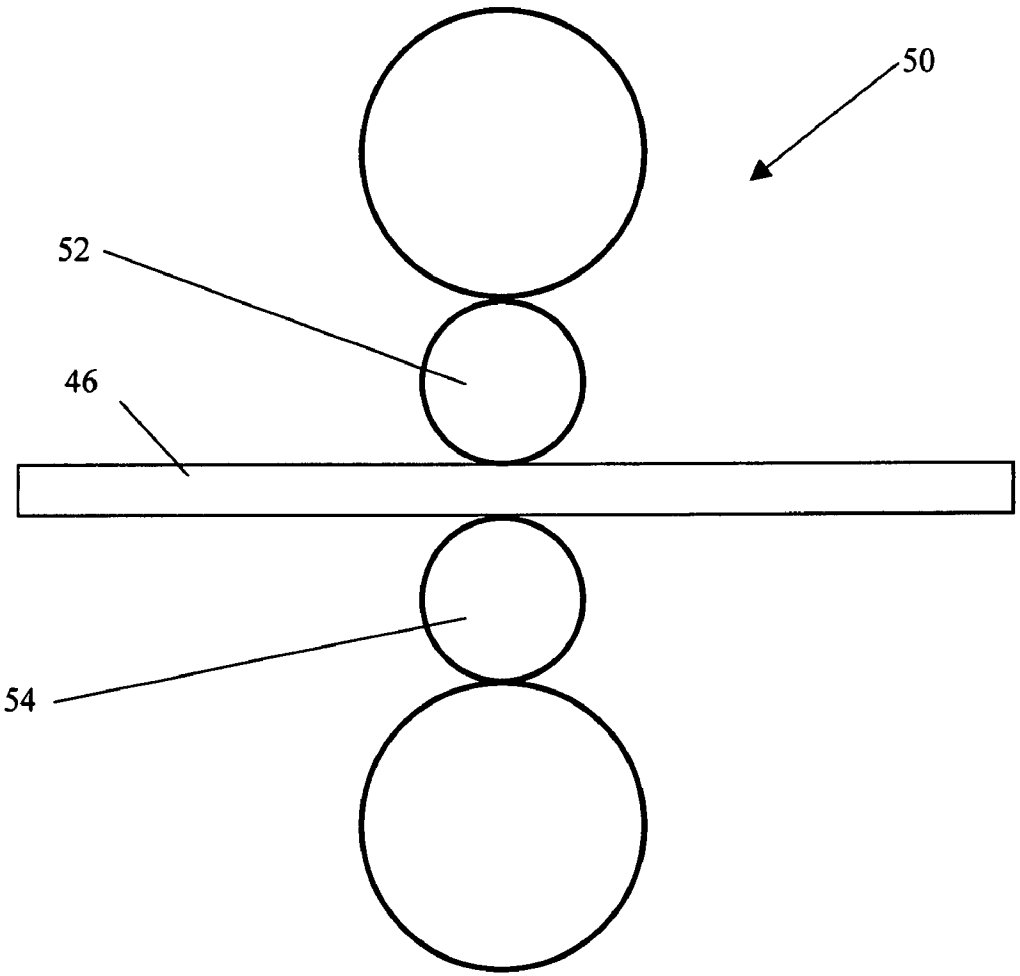
FIG. 10 is a schematic diagram showing a final-pass roller for use in an embodiment of the present process.

Alternatively or additionally to being levelled the steel may be deformed by being passed through a final-pass roller (50) for a final rolling reduction pass of the steel plate (46). As shown in FIG. 10, the steel plate (46) is passed between the final-pass upper working roll (52) and the final-pass lower working roll (54) so as to reduce the thickness of the steel plate (46). The inventors expect that if the steel is not levelled, a final rolling reduction of at least about 1% and no more than about 5% would be effective to enhance precipitation strengthening. The inventors expect that if the steel is not levelled, a final rolling reduction of at least about 2% and no more than about 2.5% would result in precipitation strengthening comparable to that produced by levelling as described above.

After the steel is deformed, it may, depending on the mill configuration, be transferred to a cooling bed (not shown) for further cooling.

Figure 3:
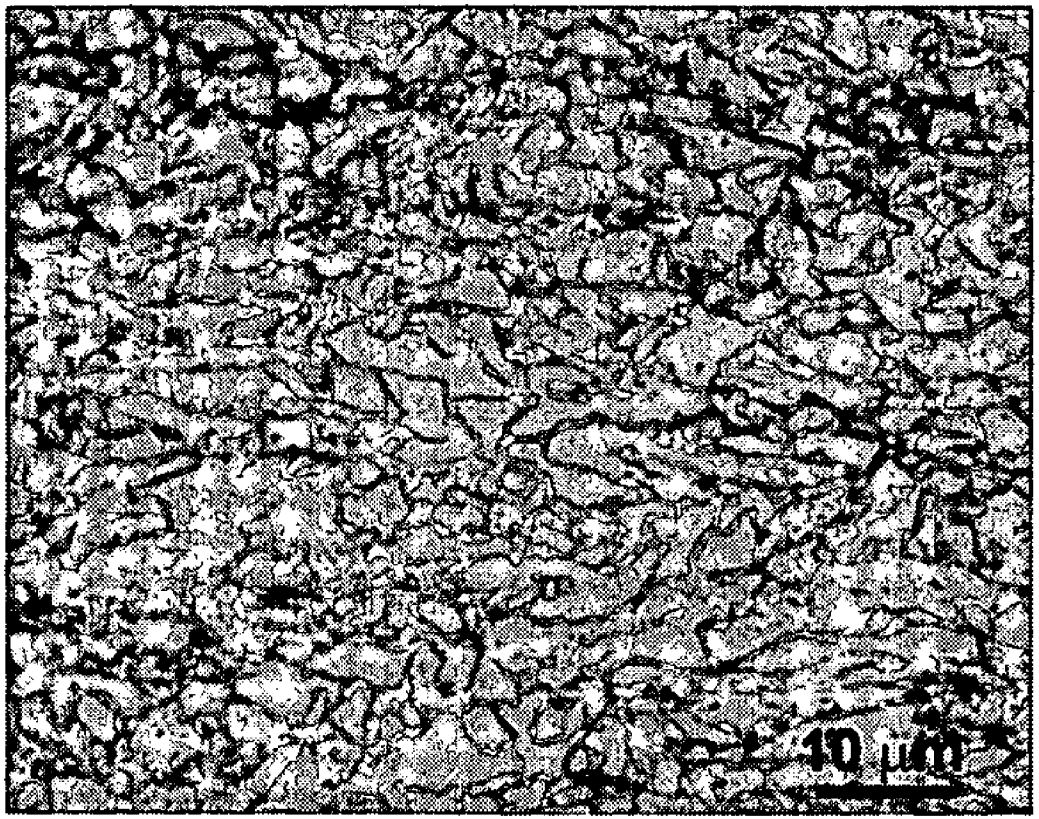
FIG. 3 is an optical microscopy image showing the microstructure of an exemplary steel produced by an embodiment of the present process.

As made by the above-described steel-making process this line-pipe-grade steel (FIG. 3) has a microstructure of about 30% polygonal ferrite and about 70% acicular ferrite with an average grain size of no more than about 5 μm; and having precipitates of NbC and Nb(C,N) with a precipitate particle size of no more than about 5 nm and probably in the range of at least about 1 and no more than about 3 nm.

Figure 4:
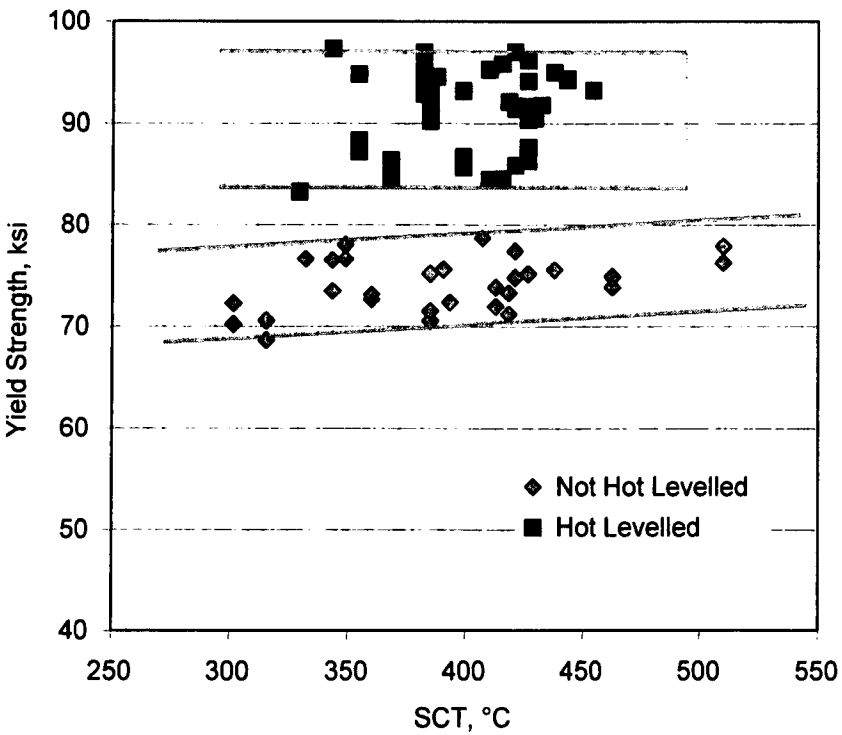
FIG. 4 is a graph prepared from experimental data showing the effect of levelling on the yield strength of various steels, with yield strength on the vertical axis and the temperature at which accelerated cooling ceased (stop cooling temperature) on the horizontal axis.
Figure 8:
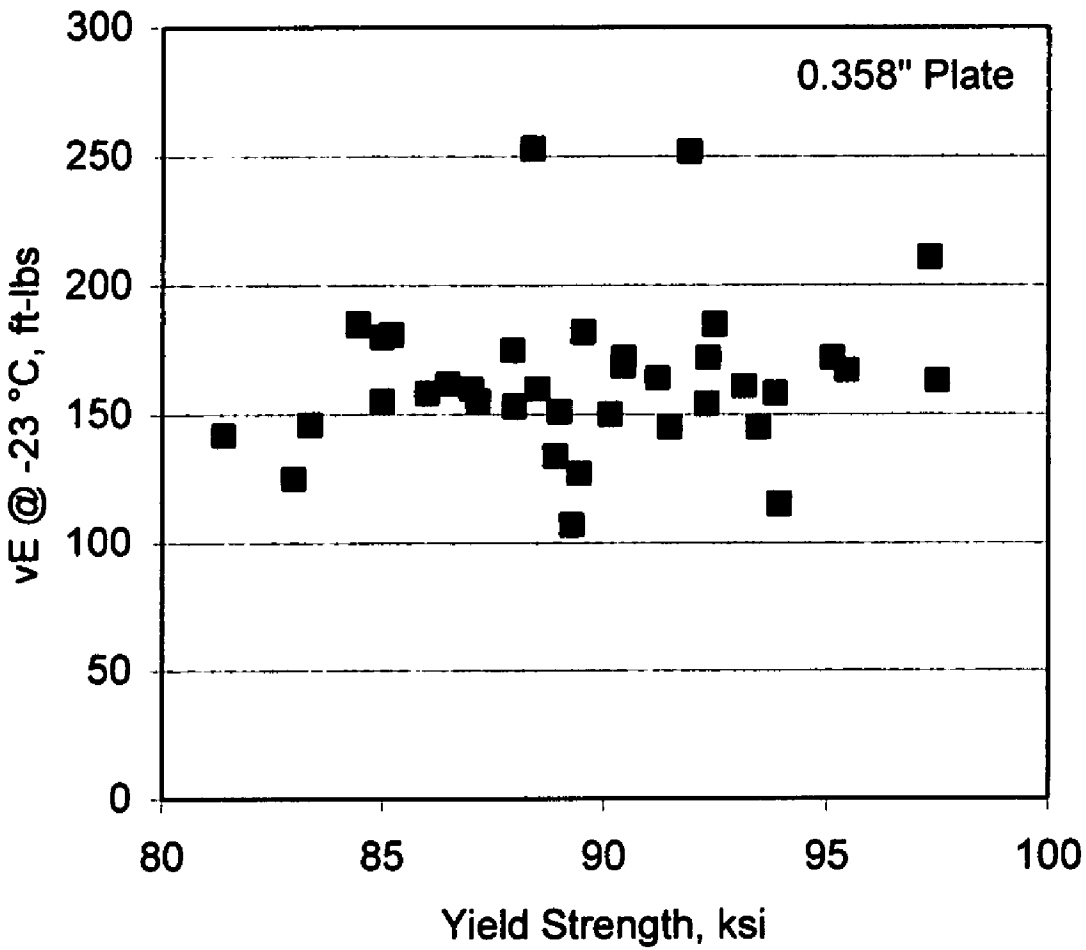
FIG. 8 is a graph prepared from experimental data showing the relationship between yield strength and toughness of steels produced by an embodiment of the present invention, with toughness on the vertical axis and yield strength on the horizontal axis.
Figure 9:
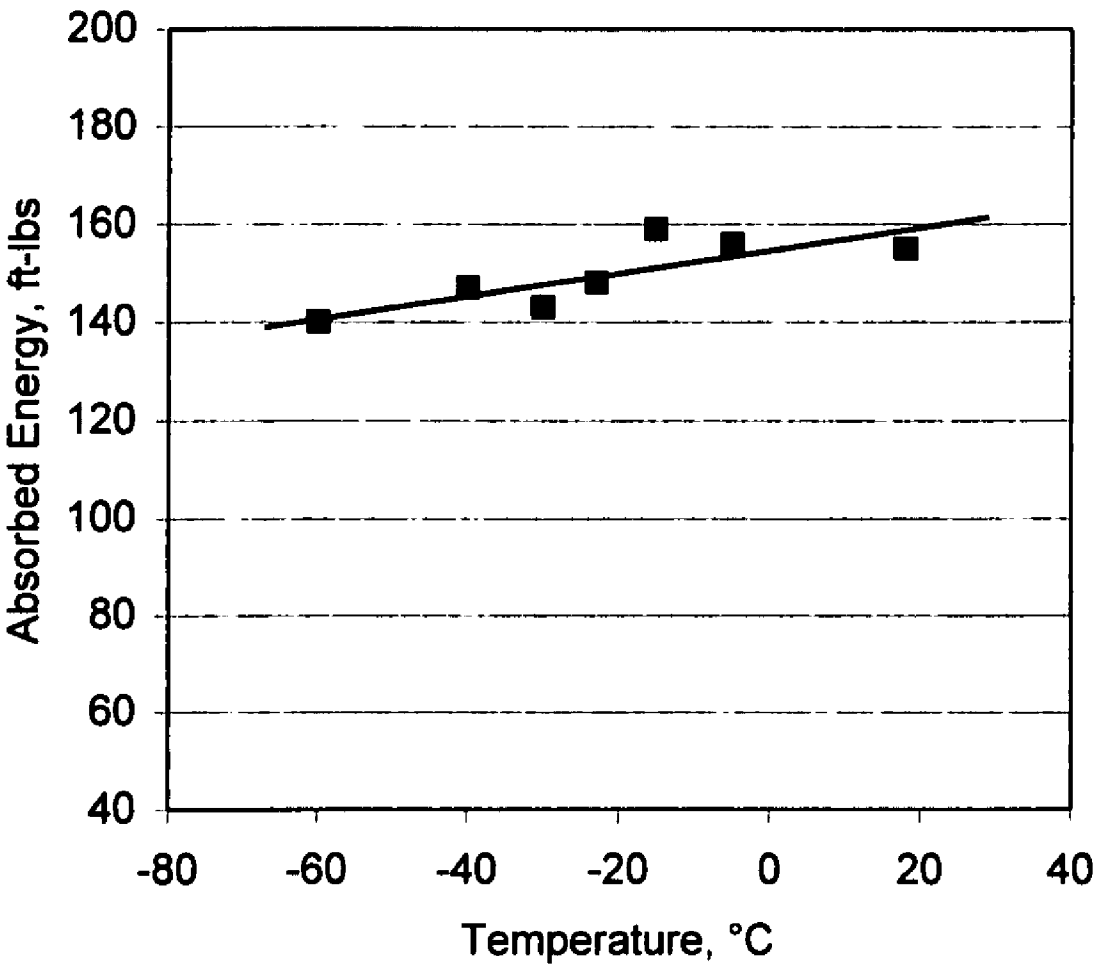
FIG. 9 is a graph prepared from experimental data showing the ductile-to-brittle transition temperature of a steel produced by an embodiment of the present process, with absorbed energy on the vertical axis and temperature on the horizontal axis.

As illustrated in FIGS. 4, 8 and 9, this line-pipe-grade steel has the following physical properties:

a) a yield strength of at least about 85 ksi (586 Mpa);

b) an impact absorbed energy of at least about 160 ft-lbs (217 J) at a temperature of about minus 23° C.; and c) a ductile-to-brittle transition temperature of no higher than about minus 60° C.

Various test steels having the chemistry of the above-described line-pipe-grade steel were made to investigate the effectiveness of the above-described process. FIGS. 8 and 9 illustrate test results for test steels corresponding to this line-pipe-grade steel. FIG. 4 illustrates test results for both test steels corresponding to this line-pipe-grade steel (identified as "Hot Levelled" in FIG. 4) and test steels not corresponding to this line-pipe-grade steel (identified as "Not Hot Levelled" in FIG. 4).

The test steels were made from 6-inch slabs. The total reduction of the roughing passes was roughly 80%. The total reduction of the finishing passes was roughly 70%. The accelerated cooling was as described above except that some of the different test steels had different stop-cooling temperatures (shown in FIGS. 4–7). As well, some of the test steels were deformed by being levelled and some were not (shown in FIGS. 4 and 5).

Transmission electron microscopy images of levelled and not-levelled test steels indicated that the volume fraction of very fine (less than about 5 nm) NbC particles was about 50% higher in the levelled test steels than in the not-levelled test steels. These very fine precipitate particles are understood to have a significant effect on yield strength. Kinetic study indicated that precipitation of NbC was minimal in the temperature range of about 350° C. to about 450° C., unless the steel was levelled.

Figure 5:
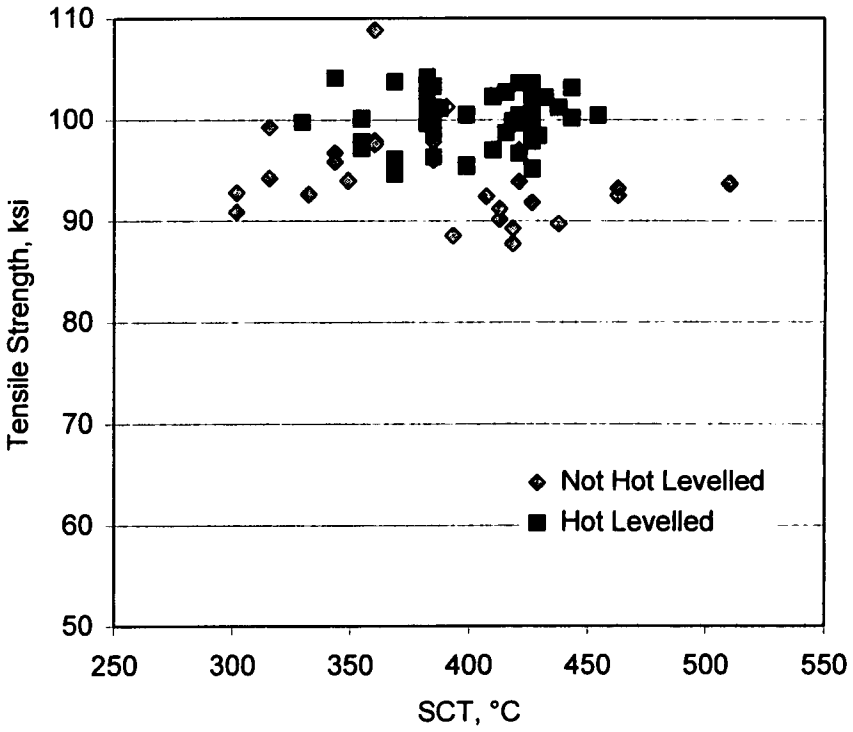
FIG. 5 is a graph prepared from experimental data showing the effect of levelling on the tensile strength of various steels, with tensile strength on the vertical axis and the stop cooling temperature on the horizontal axis.

FIG. 4 shows the yield strengths of test steel plates that were levelled as compared with the yield strengths of plates that were not levelled, over a range of stop-cooling temperatures. Levelling the test steels, significantly increased the yield strength of the test steel as compared to test steels not levelled. The levelled plates had a yield strength on average about 17 ksi (117 MPa) greater than that of the plates that were not levelled. As shown in FIG. 5, levelling also increased the tensile strength, though not as significantly as the yield strength. The levelled test steel plates had a tensile strength on average about 5 ksi (34 MPa) greater than the plates that were not levelled.

Figure 6:
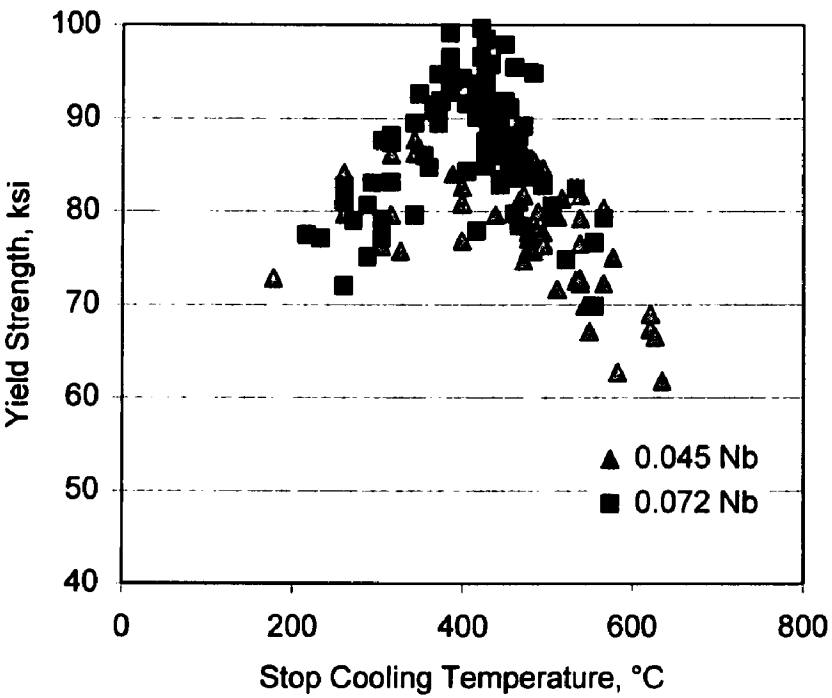
FIG. 6 is a graph prepared from experimental data showing the effect of various stop-cooling temperatures on the yield strength of steels containing different amounts of niobium, with yield strength on the vertical axis and the stop cooling temperature on the horizontal axis.
Figure 7:
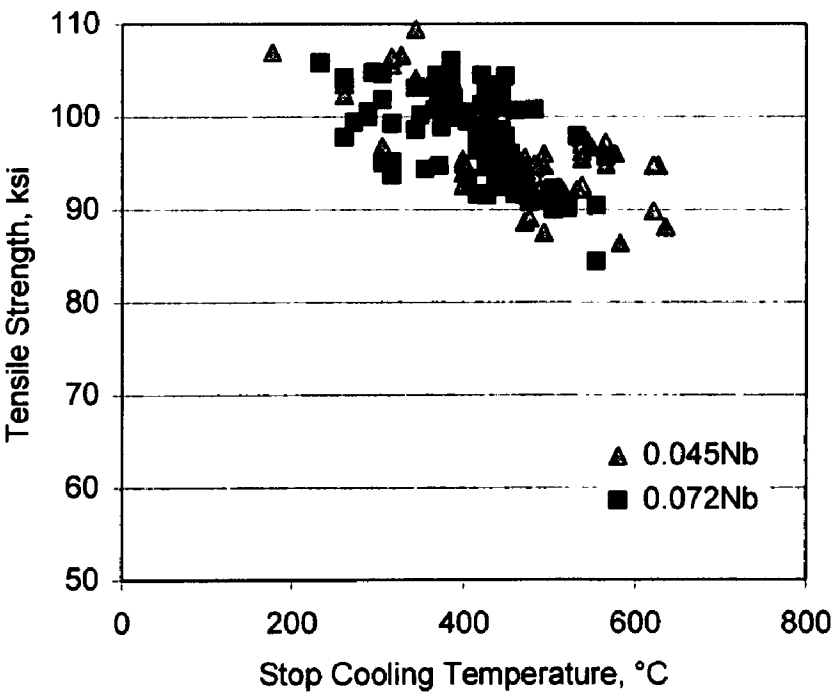
FIG. 7 is a graph prepared from experimental data showing the effect of various stop-cooling temperatures on the tensile strength of steels containing different amounts of niobium, with tensile strength on the vertical axis and the stop cooling temperature on the horizontal axis.

FIGS. 6 and 7 indicate yield strength and tensile strength, respectively, for different stop cooling temperatures, of two test steels: one containing about 0.045% wt. niobium and one containing about 0.072% wt. niobium. As indicated in FIG. 6, the yield strength was strongly affected by the stop-cooling temperature. The inventors understand that the accelerated cooling both produced the desired microstructure and reduced the number of larger-than-desired precipitate particles by reducing the amount of time for which the steel was at temperatures at which larger-than-desired precipitate particles tend to form, thereby preserving precipitating substance for precipitation at lower temperatures. As indicated in FIG. 6, a peak yield strength was achieved with a stop-cooling temperature of about 400° C. Yield strength decreased almost linearly for stop cooling temperatures above or below about 400° C. Metallographic examination revealed that, for stop-cooling temperatures above about 400° C., the increase in yield strength associated with decreasing stop-cooling temperatures was mainly due to grain refinement and a transition from more polygonal type microstructure to a more acicular type microstructure. For stop-cooling temperatures below about 400° C., the decrease in yield strength was related to a decreased rate of diffusion of the precipitating substance and a resulting slower precipitation process. As indicated in FIG. 6, for a stop-cooling temperature in a range of about 400° C.±about 100° C., a minimum yield strength of about 80 ksi (552 MPa) was obtained. For a stop-cooling temperature in a range of about 400° C.±about 20° C., a minimum yield strength of about 90 ksi (621 MPa) was obtained. Current industrial practice permits control of stop-cooling temperature in a range of about 400° C.±about 50° C., by which a minimum yield strength of about 85 ksi (586 MPa) may be obtained.

As indicated in FIG. 7, tensile strength is less sensitive to precipitation than yield strength. Tensile strength is strongly related to dislocation structure, in that a higher dislocation density in the microstructure results in a greater tensile strength.

As indicated in FIG. 8, increased yield strength of the test steels was not accompanied by a decrease in toughness. The impact absorbed energy of the 0.358" test steel plate was about 160 ft-lbs (217 J) at a temperature of about minus 23° C. for a transverse charpy specimen section size of 6.7 mm×10 mm. The impact absorbed energy is expected to be higher if a larger specimen (7.5 mm×10 mm) were to be tested. The ductile-to-brittle transition curve in FIG. 9, for a test steel having a yield strength of about 100 ksi (689 MPa), indicates that the fracture is completely ductile (as shown by the fracture appearance) down to a temperature at least as low as minus 60° C.

The foregoing is a description of preferred embodiments of the invention given here by way of example. The invention is not to be taken as limited to any of the specific compositions, parameters or characteristics as described relative to the preferred embodiments, but comprehends all such variations thereof as come within the scope of the appended claims.

The invention claimed is:

1. High-strength steel suitable for making line pipe and pressure vessels, the steel characterized by:

a) a steel composition comprising:

at least about 0.01 and no more than about 0.1% wt. carbon;

at least about 0.03 and no more than about 0.12% wt. niobium;

at least about 0.008 and no more than about 0.03% wt. titanium;

at least about 1.4 and no more than about 1.9% wt. manganese;

at least about 0.1 and no more than about 0.5% wt. molybdenum;

a maximum phosphorus content of about 0.02% wt.;

a maximum sulfur content of about 0.015% wt.;

a maximum nitrogen content of about 0.015% wt.; and the balance being iron (Fe) and incidental impurities;

b) a two phase microstructure having an increased dislocation density comprising about 30% polygonal ferrite and about 70% acicular ferrite with an average grain size of no more than about 5 μm; and c) precipitates containing niobium with a precipitate particle size of no more than about 5 nm, and further characterized by a process for producing the steel, which comprises:

d)heating the steel at a selected dissolving temperature to dissolve substantially all the niobium in the steel;

e) deforming the steel a first time while the steel is in the austenite region;

f) cooling the steel at an accelerated rate to a temperature of about 350° C. to about 450° C.; and g) deforming the steel a second time, at a temperature of about 350° C. to about 450° C., to introduce dislocations in the crystal structure of the steel so as to increase the kinetics of precipitation, to, in turn, maximize the precipitation of the niobium particles to a particle size of no more than about 5 nm.

2. The steel of claim 1, wherein the precipitate particle size is at least about 1 nm and no more than about 3 nm.

3. The steel of claim 1, wherein the steel is characterized by the following physical properties:

a) a yield strength of at least about 85 ksi (586 MPa);

b) an impact absorbed energy of at least about 160 ft-lbs (217 J) at a temperature of minus 23+ C.; and c) a ductile-to-brittle transition temperature of no more than about minus 60° C.

4. The steel of claim 1, wherein the steel contains at least about 0.015 and no more than about 0.02% wt. titanium.

5. The steel of claim 1, wherein the steel contains about 0.018% wt. titanium.

6. The steel of claim 1, wherein the sulfur content of the steel is no more than about 0.01% wt.

7. The steel of claim 1, wherein the phosphorus content of the steel is no more than about 0.018% wt.

8. High-strength steel suitable for making line pipe and pressure vessels, the steel characterized by:

a) a steel composition comprising:

at least about 0.01 and no more than about 0.1% wt. carbon;

at least about 0.03 and no more than about 0.15% wt. titanium;

at least about 1.0 and no more than about 1.9% wt. manganese;

at least about 0.1 and no more than about 0.5% wt. molybdenum;

a maximum phosphorus content of about 0.02% wt.;

a maximum sulfur content of about 0.015% wt.;

a maximum nitrogen content of about 0.005% wt.; and the balance being iron (Fe) and incidental impurities;

b) a two phase microstructure having an increased dislocation density comprising about 30% polygonal ferrite and about 70% acicular ferrite with an average grain size of no more than about 5 μm; and c) precipitates containing titanium with a precipitate particle size of no more than about 5 nm, and further characterized by a process for producing the steel, which comprises:

d)heating the steel at a selected dissolving temperature to dissolve substantially all the titanium in the steel;

e) deforming the steel a first time while the steel is in the austenite region;

f) cooling the steel at an accelerated rate to a temperature of about 350° C. to about 450° C.; and g) deforming the steel a second time, at a temperature of about 350° C. to about 450° C. to introduce dislocations in the crystal structure of the steel so as to increase the kinetics of precipitation, to, in turn, maximize the precipitation of the titanium particles to a particle size of no more than about 5 nm.

9. The steel of claim 8, wherein the sulfur content of the steel is no more than about 0.01% wt.

10. The steel of claim 8, wherein the phosphorus content of the steel is no more than about 0.018% wt.

11. High-strength steel suitable for making line pipe and pressure vessels, the steel characterized by:

a) a steel composition comprising:

at least about 0.01 and no more than about 0.1% wt. carbon;

at least about 0.03 and no more than about 0.15% wt. titanium, and a maximum niobium content of about 0.12% wt., such that the total combined amount of titanium and niobium is at least about 0.03 and no more than about 0.2% wt.;

at least about 1.0 and no more than about 1.9% wt. manganese;

at least about 0.1 and no more than about 0.5% wt. molybdenum;

a maximum phosphorus content of about 0.02% wt.;

a maximum sulfur content of about 0.015% wt.;

a maximum nitrogen content of about 0.005% wt.; and the balance being iron (Fe) and incidental impurities;

b) a two phase microstructure having an increased dislocation density comprising about 30% polygonal ferrite and about 70% acicular ferrite with an average grain size of no more than about 5 μm; and c) precipitates containing niobium and/or titanium with a precipitate particle size of no more than about 5 nm, and further characterized by a process for producing the steel, which comprises:

d) heating the steel at a selected dissolving temperature to dissolve substantially all the niobium and/or titanium in the steel;

e) deforming the steel a first time while the steel is in the austenite region;

f) cooling the steel at an accelerated rate to a temperature of about 350° C. to about 450° C.; and g) deforming the steel a second time, at a temperature of about 350° C. to about 450° C., to introduce dislocations in the crystal structure of the steel so as to increase the kinetics of precipitation, to, in turn, maximize the precipitation of the titanium and/or niobium particles to a particle size of no more than about 5 nm.

12. The steel of claim 11, wherein the sulfur content of the steel is no more than about 0.01% wt.

13. The steel of claim 11, wherein the phosphorus content of the steel is no more than about 0.018% wt.

14. High-strength steel suitable for making line pipe and pressure vessels, the steel characterized by:

a) a steel composition comprising:

at least about 0.01 and no more than about 0.1% wt. carbon;

a maximum niobium content of about 0.12% wt. and a maximum vanadium content of about 0.12% wt., such that the total combined amount of niobium and vanadium is at least about 0.03% wt. and no more than about 0.2% wt.;

at least about 0.008 and no more than about 0.03% wt. titanium;

at least about 1.0 and no more than about 1.9% wt. manganese;

at least about 0.1 and no more than about 0.5% wt. molybdenum;

a maximum phosphorus content of about 0.02% wt.;

a maximum sulfur content of about 0.015% wt.;

a maximum nitrogen content of about 0.015% wt.; and the balance being iron (Fe) and incidental impurities;

b) a two phase microstructure having an increased dislocation density comprising about 30% polygonal ferrite and about 70% acicular ferrite with an average grain size of no more than about 5 μm; and c) precipitates containing niobium and/or vanadium with a precipitate particle size of no more than about 5 nm, and further characterized by a process for producing the steel, which comprises:

d) heating the steel at a selected dissolving temperature to dissolve substantially all the niobium and/or vanadium in the steel;

e) deforming the steel a first time while the steel is in the austenite region;

f) cooling the steel at an accelerated rate to a temperature of about 350° C. to about 450° C. and g) deforming the steel a second time, at a temperature of about 350° C. to about 450° C. to introduce dislocations in the crystal structure of the steel so as to increase the kinetics of precipitation, to, in turn, maximize the precipitation of the niobium and/or vanadium particles to a particle size of no more than about 5 nm.

15. The steel of claim 14, wherein the sulfur content of the steel is no more than about 0.01% wt.

16. The steel of claim 14, wherein the phosphorus content of the steel is no more than about 0.018% wt.

* * * * *